US008217589B2

(12) United States Patent
Endres et al.

(10) Patent No.: US 8,217,589 B2
(45) Date of Patent: Jul. 10, 2012

(54) METHOD FOR TRANSMITTING CONTROL INFORMATION FROM A CONTROL DEVICE TO A LAMP UNIT AS WELL AS A CORRESPONDING ILLUMINATING SYSTEM, LAMP UNIT AND CONTROL DEVICE

(75) Inventors: Helmut Endres, Zusmarshausen (DE); Klaus Fischer, Friedberg (DE); Friedhelm Holtz, Luedenscheid (DE); Karl-Heinz Krause, Neuenrade (DE); Josef Kreittmayr, Bobingen (DE); Friedhelm Wehlmann, Oer-Erkenschwick (DE)

(73) Assignees: Osram Gesellschaft mit beschrankter Haftung, Munich (DE); Insta Elektro GmbH, Luedenscheid (DE)

( * ) Notice: Subject to any disclaimer, the term of this patent is extended or adjusted under 35 U.S.C. 154(b) by 345 days.

(21) Appl. No.: 12/692,132

(22) Filed: Jan. 22, 2010

(65) Prior Publication Data

US 2011/0101882 A1 May 5, 2011
US 2012/0062140 A9 Mar. 15, 2012

(30) Foreign Application Priority Data

Nov. 4, 2009 (DE) ..... 10 2009 051 968

(51) Int. Cl.
*G05F 1/00* (2006.01)

(52) U.S. Cl. ..... 315/306; 315/291

(58) Field of Classification Search ..... 315/246, 315/74–75, 119, 125, 207, 306, 291, 307, 315/137, 200 R, 209 R
See application file for complete search history.

(56) References Cited

U.S. PATENT DOCUMENTS

| | | | | |
|---|---|---|---|---|
| 4,321,508 | A * | 3/1982 | Adler et al. | 315/291 |
| 5,614,811 | A | 3/1997 | Sagalovich et al. | |
| 6,424,096 | B1 * | 7/2002 | Lowe et al. | 315/185 R |
| 6,476,709 | B1 | 11/2002 | Wuidart et al. | |
| 7,391,168 | B1 | 6/2008 | Dernovsek et al. | |
| 2004/0227472 | A1 | 11/2004 | Gaus, Jr. et al. | |
| 2008/0258650 | A1 | 10/2008 | Steiner et al. | |
| 2009/0251059 | A1 * | 10/2009 | Veltman | 315/200 R |

FOREIGN PATENT DOCUMENTS

| | | | |
|---|---|---|---|
| CA | 2 345 456 | A1 | 10/2002 |
| DE | 19632282 | A1 | 2/1998 |
| DE | 10315473 | A1 | 10/2004 |
| DE | 102006046629 | A1 | 4/2008 |
| DE | 60222550 | T2 | 6/2008 |
| GB | 2 335 334 | A | 9/1999 |
| WO | 99/48340 | A1 | 9/1999 |

* cited by examiner

*Primary Examiner* — Douglas W Owens
*Assistant Examiner* — Minh D A
(74) *Attorney, Agent, or Firm* — Fitch, Even, Tabin & Flannery, LLP

(57) ABSTRACT

A method is provided for driving at least one lamp unit, which is connected to an AC voltage power supply system. The method comprises modulating a control information item for the operation of the lamp unit onto the supplied AC voltage, decoding of the modulation received on the lamp unit side for reading the control information item and driving the light-emitting device in accordance with the control information item. Provision is made for a shunt to be produced in the line used for transmitting the control information item prior to or at the beginning of the modulation of the control information item. The disclosure also provides a lamp unit and a control device for implementing the method. The disclosure also provides a lighting system.

40 Claims, 4 Drawing Sheets

Figure 1:
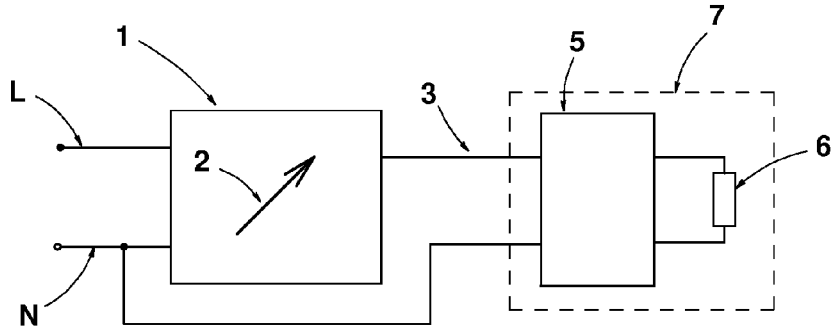

METHOD FOR TRANSMITTING CONTROL INFORMATION FROM A CONTROL DEVICE TO A LAMP UNIT AS WELL AS A CORRESPONDING ILLUMINATING SYSTEM, LAMP UNIT AND CONTROL DEVICE

The present invention relates to a method for driving at least one lamp unit, which is connected to an AC voltage power supply system, with at least one light-emitting means, comprising the following steps: modulation of a control information item for the operation of the lamp unit onto the AC voltage supplied to the lamp unit, decoding of the modulation received on the lamp unit side for reading the control information item and driving of the light-emitting means in accordance with the control information item received. In addition, the invention relates to a lighting system comprising a control device, which is connected to an AC voltage power supply system, with a modulator for generating a modulation on the system voltage, which modulation encodes a control information item for at least one light-emitting means, which control device is connected to a lamp unit, which comprises at least one light-emitting means, via a supply line for transmitting the modulation and the electrical power, which lamp unit comprises a transformer for operating the at least one light-emitting means and a decoder, which applies its output signals to the transformer, for determining and conditioning the control information item modulated on the AC voltage.

The invention furthermore relates to a lamp unit and a control device, which are suitable for implementing the method according to the invention.

Methods for driving lamp units are known. Thus, it is known to drive a plurality of electrical loads, which may also include lamp units, via a bus system. Such a service bus system transmits signals in digital form, which are decoded by a processor assigned to the respective load in order to control the power consumption or other properties of the respective load. By means of some such service bus systems it is possible to transmit control signals over the same line, which is also used for the transmission of energy for the respective load. For correct driving of the load(s), it is usually necessary for a unique address to be assigned to each of the loads. If a new load is connected, it is necessary to assign an address to this load. Such systems are therefore not suitable, at least not readily suitable, for being brought into operation in a simple manner. Also, such systems are not suitable for operating lamp units in the residential sector, where it must be possible to replace the lamp units in a simple manner.

For room lighting there is often the requirement to be able to change or regulate the brightness of light-emitting means. For this purpose, dimmers have been developed for incandescent lamps. Such dimmers are generally designed as two-wire devices for driving at least one lamp unit, with the result that said dimmers can be used readily in an existing installation instead of switches in flush-mounted boxes. Two-wire devices are understood in this context to mean devices which have only two terminals, as in the case of a simple switch. Such devices do not have a third terminal for a neutral conductor. Thus, such a device must take the energy it requires from the current flow which it is used to control. Owing to the fact that alternative light sources, such as gas discharge lamps, low-voltage halogen incandescent lamps, LEDs or OLEDs, for example, have a different response in comparison with incandescent lamps, dimmers suitable for incandescent lamps are only suitable for dimming alternative light sources with a considerable amount of additional complexity because, inter alia, the following difficulties arise in this case:

the dedicated supply of dimmers which may be required is not readily ensured; the starting of gas discharge lamps at a minimum brightness set at the dimmer is not ensured; the lamp can flicker during operation of the lamp in this dimming setting; there is a different response when mixing different lamps at a dimmer; lamps of even identical type require different dimming principles, for example phase-gating and phase-chopping dimming; there are considerable humming noises at the dimmer and the lamp and a restricted control range for the lamp units.

Since conventional incandescent lamps are intended to be replaced in the future by alternative light sources in a large number of applications, it is desirable to be able to also dim or control lamp units with alternative light sources using the customary mode of operation and with the customary convenience. This applies primarily to so-called compact fluorescent lamps with an integrated ballast (CFLi). Of interest here are energy saving lamps (ESLs). Such compact fluorescent lamps are intended for use in conventional incandescent lamp holders (for example E14 or E27) and are operated via the supply lines provided for incandescent lamps. Finally, compact fluorescent lamps are intended to replace conventional incandescent lamps without new lampholders needing to be installed or supply lines needing to be laid for this purpose. Such compact fluorescent lamps generally have electronic control gear integrated in the base thereof, with a transformer, which generates the voltages and currents required for the operation of the light-emitting means.

Furthermore, it may be desirable to also be able to control the color of the light-emitting means as well as the brightness. In particular in the case of lamp units in which the light-emitting means comprises a plurality of differently colored LEDs (light-emitting diodes), for example, it should be possible for different lighting scenarios to be configured.

Methods are known for dimming energy saving lamps in which the brightness of the energy saving lamp can be set in predetermined steps. This means that continuous regulation of the brightness of the energy saving lamp is not possible. These methods therefore do not offer the convenience in use which is customary for conventional incandescent lamp dimmers.

Attempts have been made in the prior art to use known phase-gating and phase-chopping methods to dim energy saving lamps. These methods attempt to match the ballast to the energy saving lamp in such a way that said energy saving lamp can be operated without any flicker on a phase-gated or phase-chopped system voltage. However, such methods are problematic owing to the technical properties of today's energy saving lamps as regards their electromagnetic compatibility (EMC). Thus, owing to the steep edges of the current and voltage profile which are produced during phase-gating and phase-chopping control, both radio interference and undesired system current harmonics can occur during power transmission over the existing AC voltage power supply system. Furthermore, energy saving lamps, despite the matching measures which have been carried out, have a tendency towards flicker when such an upstream dimmer is used in lower dimming settings and towards faults during striking, which is in turn perceived as a functional fault. The attempts to dim energy saving lamps by phase-gating or phase-chopping methods therefore obviously do not give the desired result, which consists inter alia in such dimmers generally requiring a continuous current flow.

U.S. Pat. No. 6,476,709 B1 has disclosed transmitting a digitally encoded information item to a device to be driven and to be supplied with the AC voltage, for example a lamp unit with a light-emitting means, in the descending part of a half-cycle of the AC voltage supply. This takes place by modulation of the control information item onto the AC voltage. For this purpose, a decoder is assigned to the control gear of the light-emitting means, which decoder reads the control information item and correspondingly drives the load, for example the transformer of the light-emitting means. This means that, once the power intended for the device to be supplied has been transmitted, the information item for driving the device, i.e. for example for the brightness, is transmitted. The level of the digital signal is in this case time-dependent. The envelope of the signal corresponds to the time profile of the unmodulated supply voltage. In the method disclosed in this document, in addition a relatively high error rate in the transmission of the control information item is considered to be disadvantageous. A further disadvantage of the method described in the abovementioned document is associated with power factor correction. Power factor correction is made markedly more difficult on the side of the control gear when the AC voltage supply is temporarily interrupted.

Against this background, the invention is based on the object of proposing a method for driving at least one lamp unit by means of a control device which does not have the mentioned disadvantages primarily for dimming an energy saving lamp and which opens up the possibility of setting further operational parameters for a lamp unit. Furthermore, it is an object of the present invention to specify a lamp unit and a control device with which the method according to the invention can be implemented. Finally, it is an object of the present invention to specify a lighting system expediently for implementing the method according to the invention.

In the text which follows, the invention will be described substantially using the method according to the invention. All statements in this regard also apply analogously to the control device according to the invention, the lamp unit according to the invention and the lighting system according to the invention.

The method-related object is achieved by a method as claimed in claim 1.

The method-related object is achieved by a method of the generic type as mentioned at the outset, in which a shunt, which acts in parallel with the supply terminals of a lamp unit via which the control information item is transmitted, is activated prior to or at the beginning of the modulation of a control information item (modulation phase) and furthermore can be activated prior to or at the beginning of a supply phase for a control device (supply phase).

In the method according to the invention, a shunt is produced prior to or at the beginning of the modulation of a control information item. Producing a shunt is used to provide defined potential ratios in the line used for the transmission of the control information item. By virtue of such a shunt, the line used for transmitting the control information item is shut off at a defined impedance, which can be determined by the parasitic effects of said line. Parasitic effects such as, for example, a capacitance or inductance per unit length of line or crosstalk between adjacently laid lines can disrupt the transmission of the control information item. The impedance of the shunt is now selected in such a way that faults to be expected are effectively suppressed.

Advantageously, the shunt can be switched: i.e. it can be activated and deactivated. This is advantageous since the shunt causes losses and can be interrupted at times in which it is not required.

Advantageously, the shunt contains a current-limiting element. In the simplest case, this current-limiting element is a resistor.

Advantageously, the current-limiting element is in the form of a current drain, with which a maximum shunt current can be predetermined. This is advantageous because the maximum shunt current can thus be matched to different phases of the method according to the invention. The maximum shunt current can also be matched to different operating conditions such as temperature or system voltage. In addition, it is advantageous if the maximum shunt current is independent of the voltage present at the supply terminals.

Typically, the current drain is in the form of a transistor, which, in its saturation region, limits the current flowing through it.

In order to suppress faults during a modulation phase, it has been established that a shunt advantageously has a maximum shunt current in a range of from 2 mA to 30 mA; 20 mA are preferably realized.

The control information item modulated on the AC voltage supplied to the light-emitting means can be received without any interference on the side of the lamp unit and decoded by means of the shunt. In addition to this measure, it is also possible for the claimed method to provide for the control information item to only be modulated onto the supply voltage in those phases of a half-cycle in which the driven light-emitting means does not consume any operating energy or consumes substantially no operating energy or consumes no notable operating energy.

The term "modulation phase" used in the context of these embodiments is understood to mean that part of a half-cycle in which an information item is impressed onto the AC voltage supplied to the lamp unit.

The term "supply phase" used in the context of these embodiments is understood to mean that part of a half-cycle in which a control device can be supplied with energy via a supply line between the control device and the lamp unit.

The term "shunt phase" used in the context of these embodiments is intended to mean those parts of a half-cycle in which the shunt is active.

The term "operating phase" used in the context of these embodiments is understood to mean those parts of a half-cycle in which the lamp unit consumes energy for generating light.

As has already been mentioned above, a method according to the invention can advantageously provide for the shunt to be activated for the entire modulation phase. It generally applies that a shunt phase is preferably also used in the above-mentioned method in order to supply the control device with operating energy. The supply of operating energy to the control device can also take place outside the modulation phase in a supply phase, provided that the shunt is also activated in the supply phase of the half-cycle. In control devices using the above-described two-wire technology, there is the problem that the control device can only be supplied with energy when the lamp unit permits a current flow. This naturally takes place during the operating phase. However, the AC power supply system should be connected to the lamp unit by the control device during the operating phase at a resistance which is as low as possible in order for safe operation of the light-emitting means to be ensured. Energy consumption by the control device during the operating phase should therefore be avoided, or restricted to times at which the lamp unit only draws a low current, in comparison with a current in the vicinity of the system voltage maximum. Lamp units without any complex power factor correction and with a so-called storage capacitor have an operating phase only in the temporal vicinity of the voltage maximum of the AC voltage power supply system. Outside the operating phase, the modulation phase or particularly advantageously the supply phase can now advantageously be used for supplying energy to the control device.

In order to reduce power losses present in the lighting system, a method according to the invention can advantageously provide for the value of the current flowing through the shunt during a shunt phase to assume different values, for example a lower value during the modulation phase than during the supply phase.

In this case, it is particularly advantageous for the shunt only to be activated when the magnitude of the voltage between the supply terminals is below a predetermined value. This can ensure that the power loss in the shunt does not result in destruction thereof. It has been shown that a value of 100 V is favorable for said predeterminable value.

In this case it is particularly advantageous if, in the case of a supply phase which is in the first part of the half-cycle, the maximum shunt current is predetermined by the decoder in such a way that it is increased in a time-controlled manner starting from the zero crossing of the AC voltage power supply system for a predeterminable period of time, for example 600 μs-800 μs, advantageously 700 μs, for example to 200 mA-400 mA, advantageously 300 mA. Thus, the control device can be supplied with energy rapidly with low losses.

In the case of a supply phase in the last part of the half-cycle, it is advantageous if the value of the maximum shunt current is predetermined by the decoder in such a way that it is increased in a time-controlled manner for a predeterminable period of time, for example 600 μs-800 μs, advantageously 700 μs, prior to the subsequent zero crossing to be expected of the AC voltage power supply system, for example to 200 mA-400 mA, advantageously 300 mA.

The value of the maximum shunt current made possible by a lamp unit is intended to be higher in the supply phase than the current drawn by the control device for maintaining the supply to said control device in this phase in order to keep the power loss in the lamp unit low.

This is advantageously ensured by virtue of the fact that the supply phase has a first and second part. The first part is time-limited, as described above, with the times being set to be slightly shorter for the lamp unit than for the control device. In the second part, the maximum shunt current has a reduced value. This reduced value is selected in such a way that, even without any current limitation by the control device, i.e. when the AC voltage power supply system is applied directly to the supply terminals, the shunt is not destroyed by an excessively high power loss. While the lamp unit is already in the second part of the supply phase, the control device can safely set its current-limiting effect and connect the AC voltage power supply system directly to the lamp unit. Advantageously, the shunt current is activated in the second part of the supply phase because then the switching operations at the end or at the beginning of the supply phase take place on no load.

When the lamp unit is operated directly on the AC voltage power supply system, the decoder identifies the absence of the control information item, whereupon the lamp unit deactivates the shunt at least in the supply phase.

In order to ensure that the energy supply to the control device is maintained even when the lamp unit is switched off, provision is furthermore made for firstly the shunt to be continuously activated in this case and secondly for the control device not to apply a voltage which is above a predeterminable value to the lamp unit, in order to prevent the transformer or the light-emitting means from being switched on. In the off state of the lamp unit, the control device must apply a voltage required for maintaining the shunt to the lamp unit at least temporarily.

This method, in which the modulation phase is limited to parts of a half-cycle, can advantageously make use of the fact that, in many cases, lamp units substantially consume energy only after a specific phase angle and the significant energy consumption is discontinued even before the end of the half-cycle. This is the case with many energy saving lamps. Therefore, in this method the modulation phase and the supply phase can be restricted to phase angle intervals of a half-cycle in which the lamp unit consumes no or substantially no energy. The operating energy consumption of such a lamp unit during each half-cycle therefore runs undisrupted since, in principle, all of the energy required for proper operation of the lamp unit is available. The lamp unit can readily be driven in terms of its operating mode, for example with respect to its brightness, via the control information item transmitted with the half-cycle.

It has been shown that many energy saving lamps only begin to consume energy from the AC voltage power supply system at a phase angle of approximately 60°, and the energy consumption is already ended at a phase angle of approximately 90-100°. In the case of such energy saving lamps, the modulation phase for the transmission of the control information item can be provided either in the first part of the half-cycle or in the last part of a half-cycle, to be precise outside the phase angle interval which is required by the lamp unit at least substantially for its operating energy consumption. The phases of the half-cycle which are not used or are substantially not used by the lamp unit for its operating energy consumption can be used not only for the transmission of the control information item, but also for the supply of operating energy to the control device by virtue of the provision of a supply phase. Depending on the design of the lighting system and the requirements to which it is subject, the modulation phase and the supply phase can be provided in the same part of the respective half-cycle. It is likewise possible to provide both phases in different half-cycle parts, for example the modulation phase in the first part of the half-cycle and the supply phase in the last part of the half-cycle, or vice versa.

Since the shunt is controlled on the side of the lamp unit, the shunt current can be used for transmitting information items from the lamp unit to the control device. This information item can be encoded by the level of the shunt current and/or by specific clocking thereof.

The modulated AC voltage is transmitted to a lamp unit via a supply line. Both the electrical power required by the lamp unit and the control information item for the operation of the light-emitting means are transmitted via the supply line. In this case, the supply line may be a power line with two-wire technology, which is laid permanently for operating a room lighting system, or else the connecting line which is assigned to a movable lighting device. The control gear is in this case preferably arranged in the direct spatial vicinity of the light-emitting means. Typically, the control gear is located in integrated fashion in the base of the light-emitting means, as is the case for compact fluorescent lamps. However, it is also possible for parts of the lamp unit to be accommodated in a separate housing, separately from the light-emitting means.

The decoder of the lamp unit decodes the control information item transmitted with the modulated AC voltage and applies the required control information item to a transformer connected upstream of the light-emitting means. At the same time, the modulated AC voltage is used for supplying energy to the entire lamp unit.

The control information item can be encoded digitally, with it being possible in principle for any desired digital code to be used. In a preferred embodiment, the level of the modulated voltage is substantially constant. As a result, particularly safe decoding is ensured and it is ensured that the requirements in terms of electromagnetic compatibility are met. In particular, the modulation voltage is modulated in substantially square-wave form, with the level of modulation voltage being approximately from 2 V to 10 V, in particular 4-5 volts. This makes it possible to use inexpensive circuitry for digital decoding.

A preferred embodiment provides for the use of a Manchester code as the coding.

The control information item can be transmitted within an individual half-cycle, depending on the size and the coding used. However, it may also be necessary to distribute the control information item over a plurality of preferably successive half-cycles.

The control information item transmitted via the modulated AC voltage can relate to the brightness and/or the color of the light-emitting means, for example. Thus, the control device can be in the form of a dimmer, in which case the brightness of the light-emitting means can be set via a control element, for example a rotary knob or a pushbutton. Corresponding to the setting of the control element, a coding is generated which is transmitted to the lamp unit, is decoded there and drives the transformer in such a way that the power transmitted to the light-emitting means is regulated corresponding to the set brightness or color. Equally, the light-emitting means can be driven, in addition to numerous other operating programs, for example for implementing a blink mode.

The method described is primarily suitable for driving at least one compact fluorescent lamp or one energy saving lamp. However, said method is also suitable for driving other light-emitting means, for example an LED lamp. In the case of an LED lamp which comprises a plurality of light-emitting diodes (LEDs) of different colors (for example an RGB lamp), the color of such a lamp can also be set by the control information item and corresponding driving of the individual color channels. For this purpose, the control device can have a plurality of control elements, which make it possible, for example, to individually set the brightnesses of the LEDs in the RGB system or else to set the color (hue), saturation and brightness (lightness) in the HSL system.

The modulation takes place at a frequency which is higher than the frequency of the AC voltage power supply system. The fundamental of the modulation is typically in a range of between 1 kHz and 20 kHz, preferably between 3 kHz and 10 kHz, in particular approximately 10 kHz. Firstly, this makes it possible to transmit an information item sufficiently quickly, and secondly these frequencies are still low enough to ensure a low level of interference and to suppress possible crosstalk of the control signals or of the modulation onto parallel lines and parallel-connected identical lighting systems to a sufficient extent. This also ensures that a plurality of compact fluorescent lamps or a plurality of control devices can be operated independently of one another and without any mutual interference with the method according to the invention in an AC voltage power supply system.

In accordance with a preferred embodiment, the control device and the control gear are connected in series. If an existing lighting device is converted to the system according to the invention, the existing installation can be maintained unchanged. For example, a switch or a dimmer suitable for an incandescent lamp can be replaced by a control device according to the invention, in particular when the control device has a compact design and can be used in place of a conventional switch or dimmer in a flush-mounted box.

In accordance with a further preferred embodiment, in which the control device and the control gear are connected in series, the shunt can be at least temporarily activated in order to supply energy to the control device even when the light-emitting means is switched off.

In order to control the current consumption of the control device in the case of a two-wire circuit, a shunt, in particular an activatable shunt, is preferably assigned to the lamp unit. This shunt can be in the form of a constant current source, which is controlled by the decoder of the lamp unit. In the simplest case, this shunt can be in the form of a resistor, with a switch being provided in order to activate the shunt. For example, the switch can be operated in a voltage-dependent manner or else by a processor contained in the decoder in a time-controlled or event-controlled manner. The shunt also ensures a current flow through the control device when the lamp unit is not drawing any notable current from the supply system which is required for operation of the light-emitting means. In this case, it is of no consequence if a current flow takes place in the control gear in those phases of a half-cycle in which the lamp unit is consuming substantially no operating energy. It is therefore possible that data transmission and/or energy supply to the control device can be performed in this state. As a result, by activation of the shunt at voltage values of the supply system at which the lamp unit is not consuming substantial operating energy, the current supply to the control device can be ensured even when the light-emitting means is switched off.

In a preferred embodiment, the control gear and the light-emitting means are combined to form a compact lamp unit. This has the advantage that when the light-emitting means is replaced, the control gear appropriate for this light-emitting means is always provided, as well as the particular advantage that the compact lamp unit can have, for example, an E14 or E27 screw-type base and can therefore be inserted into an existing lampholder. Such a compact lamp unit may be an energy saving lamp or a compact fluorescent lamp.

In particular when the ballast and the light-emitting means form a compact lamp unit, all of the supply lines provided for a conventional incandescent lamp lighting system, including the lampholders and the wall installations, can continue to be used when converting to alternative light sources for the purposes of the described method or in order to form a lighting system as described.

Figure 2:
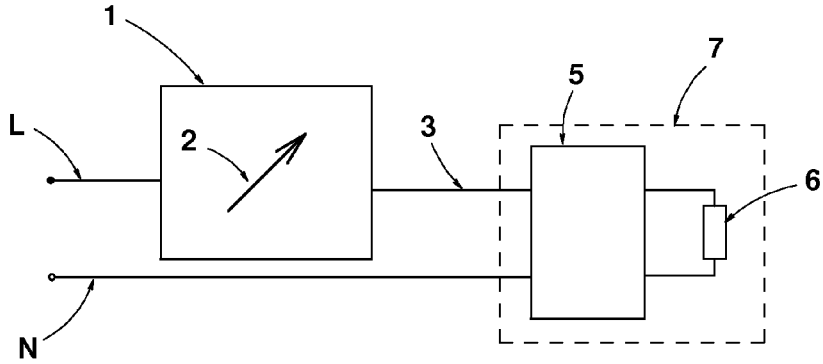
Figure 3:
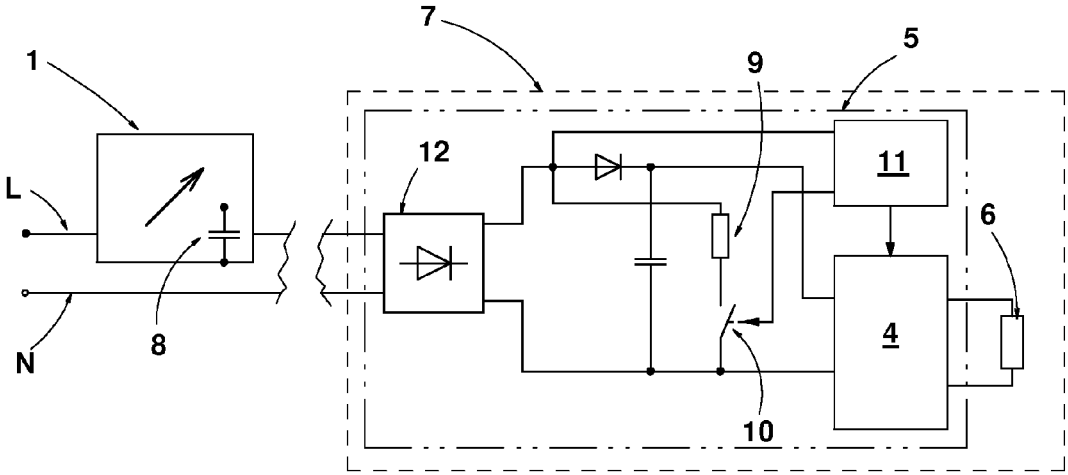
Figure 4A:
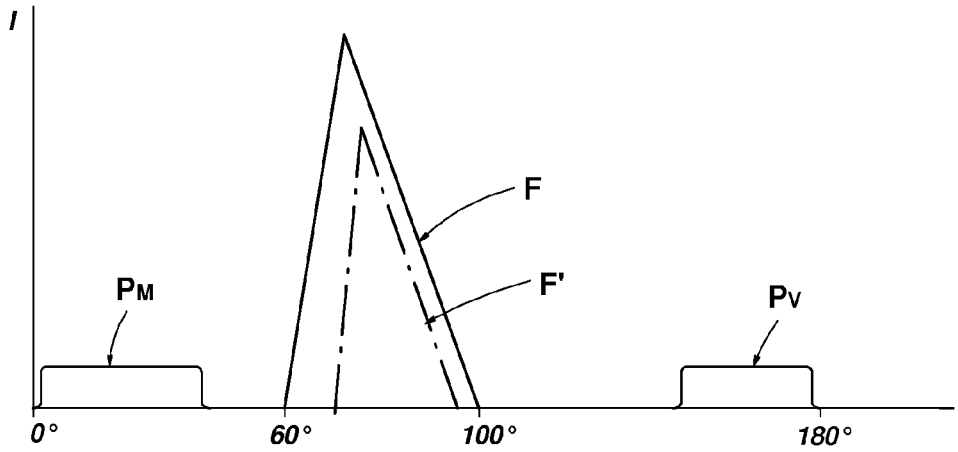
Figure 4B:
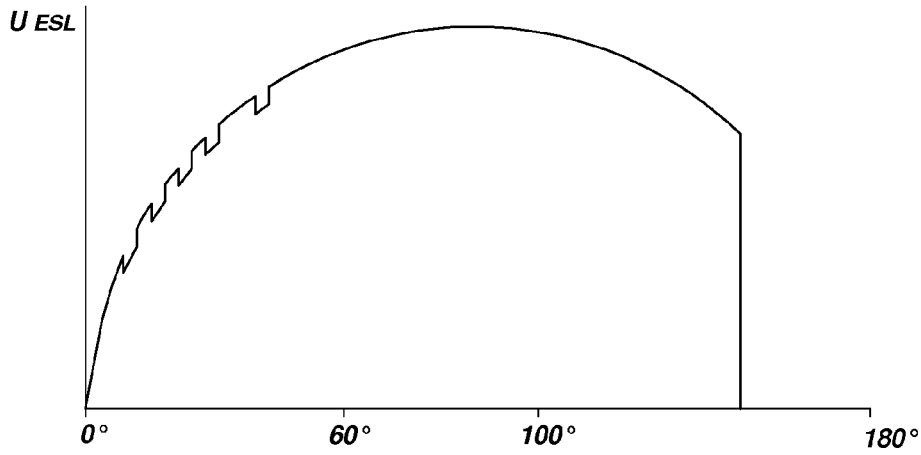
Figure 4C:
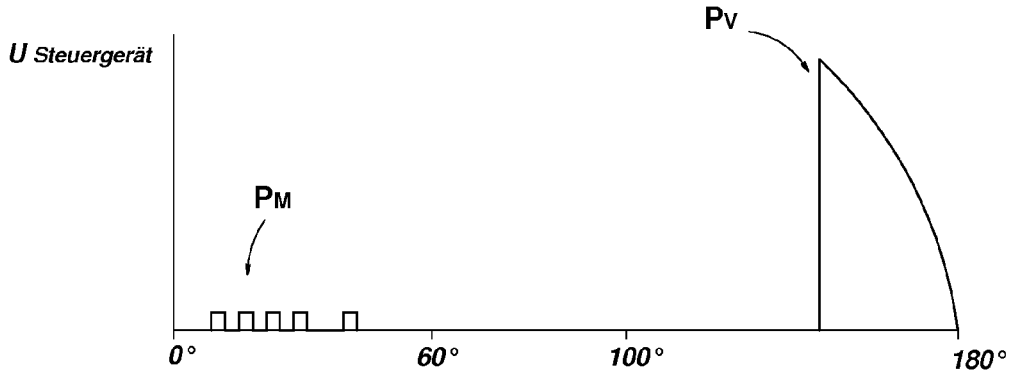
Figure 5A:
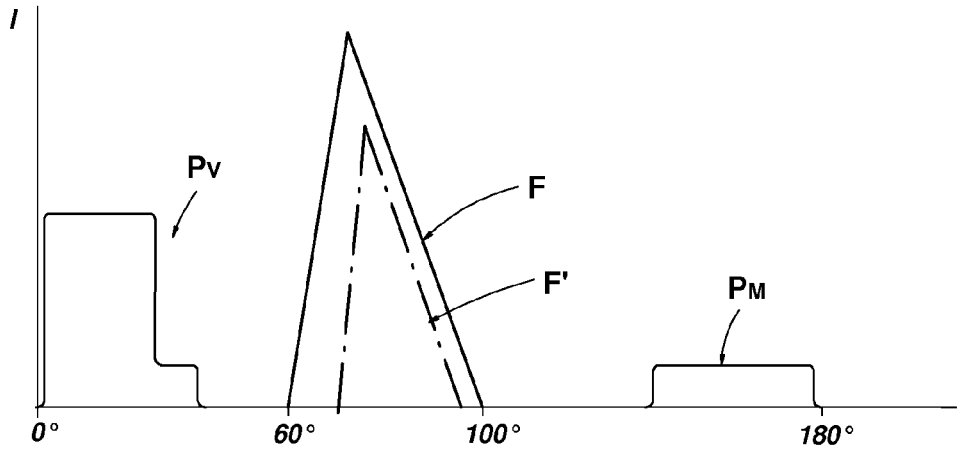
Figure 5B:
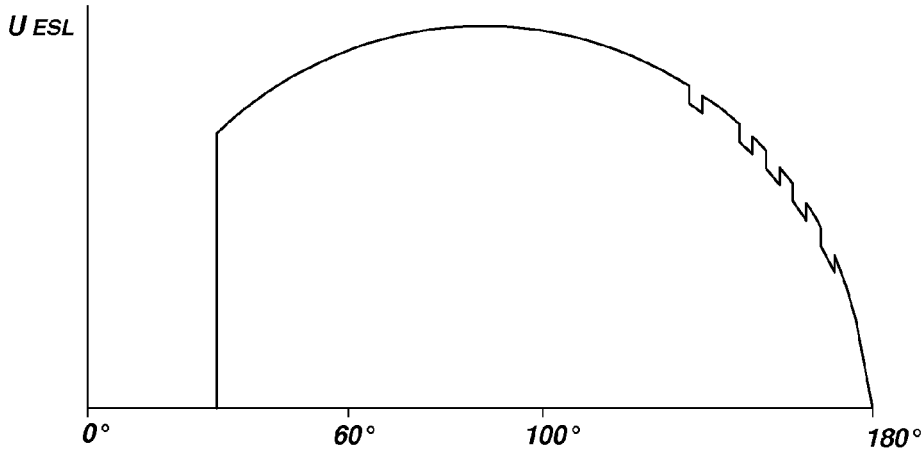
Figure 5C:
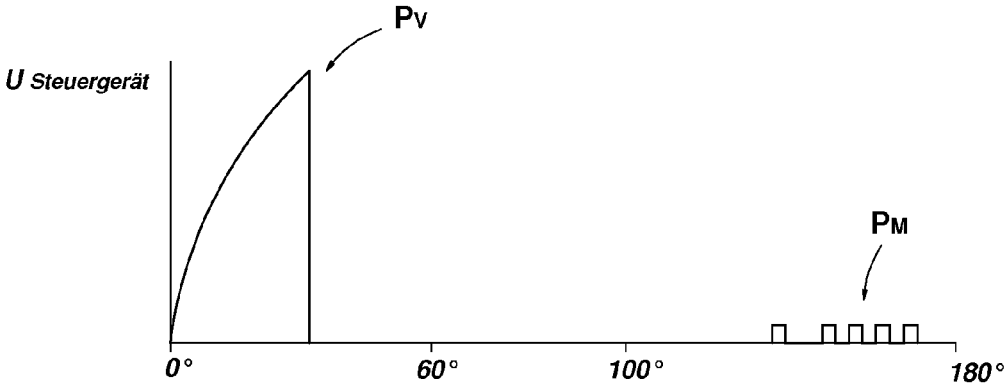
Figure 6:
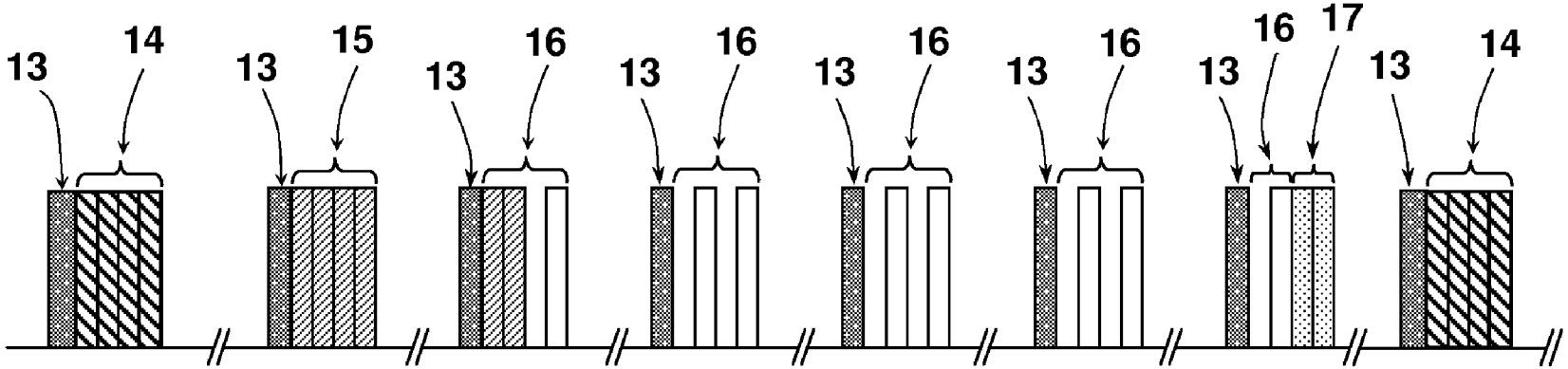

Further advantages and refinements of the invention are given in the description below relating to exemplary embodiments with reference to the attached figures, in which:

FIG. 1 shows a schematic circuit arrangement in the form of a block circuit diagram for a first exemplary embodiment of a lighting system, comprising a control device and a lamp unit, FIG. 2 shows a schematic circuit arrangement in the form of a block circuit diagram for a second exemplary embodiment of a lighting system, comprising a control device and a lamp unit, FIG. 3 shows the circuit arrangement shown in FIG. 2 in a more detailed illustration of the assemblies of the lamp unit, FIGS. 4*a-c* show graphs of the current and voltage profile of the lamp unit and the control device, in accordance with a first method refinement, FIGS. 5*a-c* show graphs of the current and voltage profile of the lamp unit and the control device, in accordance with a further method refinement, and FIG. 6 shows an example of a data telegram for transmitting control information items to the lamp unit.

In accordance with the circuit arrangement shown in FIG. 1, a lighting system comprises a control device 1 with a control element 2, which can be in the form of a pushbutton or a rotary knob, for example. The control device 1 is connected on the input side to a phase L and a neutral conductor N of an AC voltage power supply system, for example to the supply system which is conventional in Europe with 230 volts of effective AC voltage. On the output side, the control device 1 is connected to a control gear 5 via a supply line 3, which control gear is additionally connected on the input side to the neutral conductor N and which in turn operates a light-emitting means 6. In the exemplary embodiment illustrated in the figures, an energy saving lamp (ESL) is provided as the lamp unit 7 with the light-emitting means 6. A transformer (not illustrated in FIG. 1) converts electrical energy from the AC voltage power supply system into a form for operating the light-emitting means 6. The transformer 4, as part of the energy saving lamp, comprises the necessary equipment for operating said lamp. The essential assemblies of the control gear 5 are described in more detail in FIG. 3. The control gear 5 and the light-emitting means 6, as the lamp unit 7, form the energy saving lamp.

A control information item can be input via the setting of the control element 2 of the control device 1, for example by rotation of a rotary knob or actuation of a pushbutton, which control information item is converted by the control device 1 into a modulation, which is transmitted to the lamp unit 7 with the supply voltage which is transmitted via the supply line 3. The modulation is decoded on the lamp side by a decoder 11, which is assigned to the control gear 5, and is used for driving the light-emitting means 6 via the transformer 4. For this purpose, the control device 1 and the control gear 5 have corresponding signal processing units, such as processors, for example microprocessors.

In the lighting system shown in FIG. 2, the control device 1 is connected in series with the lamp unit 7. A direct connection between the control device 1 and the neutral conductor N is not provided. The components of the lighting system shown in FIG. 2 are denoted by the same reference symbols as for the lighting system shown in FIG. 1.

One or more further lamp units can be connected to the control device 1 in parallel with the lamp unit 7. These parallel-connected lamp units are then operated jointly via the control device 1, which is connected upstream of said lamp units.

The control device 1 comprises a modulator (not illustrated in the figures) for modulating a control information item onto specific components of the half-cycles of the AC voltage power supply system (L, N) which are supplied to the lamp unit 7. The control information item itself is set via the control element 2, as has already been explained briefly above. The control information item may be, for example, an information item regarding the brightness and/or another operational setting of the lamp unit 7, in particular of the light-emitting means 6 assigned to the lamp unit 7.

FIG. 3 illustrates the control gear 5 of the lamp unit 7 with its essential equipment in addition to the light-emitting means 6. The control gear 5 comprises a shunt resistor 9, which can be activated via a switch 10. The decoder assigned to the control gear 5 for decoding the transmitted control information item is denoted by the reference symbol 11. On the input side, the lamp unit 7 has a full-bridge rectifier 12, which is connected to the supply line 3 and the neutral conductor N. The decoder 11 applies the decoded control information item to a transformer 4, which acts on the light-emitting means 6. The decoder 11 likewise drives the switch 10. The lamp unit 7 can comprise further circuits which may be required for operating the light-emitting means 6, for example for current limitation or for generating a higher frequency, which circuits are generally implemented in an integrated transformer 4 of a compact fluorescent lamp.

Furthermore, a capacitor 8 in the form of an energy store, which is only illustrated symbolically in terms of circuitry, is assigned to the control device 1, and said capacitor 8 is used to supply operating voltage to the control device 1, as is explained below. If the control device 1 draws its operating voltage via the shunt of the lamp unit 7, the capacitor 8 is charged. The operating energy emission of the energy store takes place in those operating states of the lighting system in which the control device 1 is not consuming any energy.

The positive and negative components of the AC system voltage applied via the phase L and neutral conductor N are rectified by the rectifier 12, with the result that two positive half-cycles are available at the output of the rectifier within an AC voltage period. At a low voltage, i.e. in the lower section of the rising part of a half-cycle, no energy, at least no energy which is essential for operation of the lamp unit 7, is consumed by the lamp unit 7.

The current consumption of the lamp unit 7 in accordance with a first method refinement is illustrated in the graph shown in FIG. 4*a*. It can be seen from said figure that the lamp unit 7 consumes its operating energy in an interval between approximately 60 degrees and approximately 100 degrees of each half-cycle. The curve of the operating current consumption is illustrated in FIG. 4*a* by the reference symbol F, to be precise during operation of the light-emitting means 6 on full power. The dashed curve F' describes the operating current consumption in the dimmed state.

In the first part of the half-cycle, the modulation phase $P_M$ is illustrated in schematic form in FIG. 4*a*. The modulation phase $P_M$ is ended before the lamp unit 7 consumes operating energy and therefore before a phase angle of 60 degrees is reached. The last part of the half-cycle is in the form of a supply phase $P_V$ in the exemplary embodiment illustrated. As a result of the series circuit comprising the control device 1 and the lamp unit 7, when the shunt switch 10 is connected, the control device 1 can consume operating energy for itself and can charge its energy store (capacitor 8). If, on the other hand, the shunt switch 10 is open, the control device 1 cannot consume any power from the AC voltage applied. In order nevertheless to supply the control device 1 with the required energy when the switch 10 is open, the capacitor 8 is used, which feeds the control device 1 with energy in these phases. The subsequent half-cycles (not illustrated in any more detail in FIG. 4*a*) likewise each have a further modulation phase since the control information item to be transmitted is split into a plurality of successive half-cycles. In addition, in the exemplary embodiment illustrated, the control information item is transmitted cyclically continuously. Since the following modulation phase precedes directly the supply phase $P_V$ of the preceding half-cycle, it is ensured that any parasitic capacitances which are present hi parallel with the load are discharged and the input voltage of the load in the zero crossing of the AC supply voltage likewise becomes zero.

FIG. 4*b* shows the voltage profile across the lamp unit 7. During the modulation phase $P_M$, the control information item is modulated onto the AC voltage supplied to the lamp unit 7, to be precise with a largely constant modulation voltage. In the last part of the half-cycle, a supply phase takes place in which the control device has a current-limiting effect and therefore reduces the voltage across the lamp unit.

FIG. 4*c* shows the voltage profile during the above-described different phases of a half-cycle across the control device 1. It can clearly be seen that, in the supply phase $P_V$, there is a greater voltage drop across the control device 1 than during the modulation phase $P_M$ in the first part of the half-cycle.

In the exemplary embodiments described, the control element 2 is used for setting the brightness of the light-emitting means 6 and therefore dimming the latter. The control information item to be transmitted to the transformer 4 is therefore a controlled variable, which corresponds to a perceivable brightness value as a sensory impression. Correspondingly, a corresponding dimming curve can be stored in the control device 1. The control element also has an off setting or a separate on/off switch is provided. In the off state, the transformer of the lamp unit 7 is not in operation. However, it is desirable for the control device 1 to be supplied with electrical energy in this case too in order to supply the microprocessor, which is required for identifying actuation of the pushbutton, for example. Data transmission must not take place in the off state.

Embodiments of the control device with a mechanical on/off switch are likewise possible. In such a configuration, the control device is isolated from the power supply system in the off state. When the control device is switched on, it is initialized and assumes the normal operating response.

The modulation takes place by superimposition of a square-wave modulation voltage with a constant level on the envelope of the supply voltage applied to the lamp unit. High-pass filtering is therefore carried out in the decoder 11 in order to separate the data signal from the AC voltage. The voltage level of the modulation is from 4 to 5 V, for example.

For the purposes of a comparison, the operating current consumption curve of the lamp unit 7 during dimmed operation of the light-emitting means 6 is shown by dash-dotted lines using the curve F' in FIG. 4*a*. The curve F' is much narrower than and phase-shifted with respect to the curve F, which describes the current consumption of the lamp unit 7 on full power. The two curves F, F' illustrate that the current consumption of the lamp unit is uninfluenced by the modulation phase $P_M$ and the supply phase $P_V$. The light-emitting means 6 can therefore be dimmed without needing to accept any disadvantages, as described above.

FIGS. 5*a-c* show a further method refinement for driving the light-emitting means 6 of the lamp unit 7. In contrast to the method described in FIGS. 4*a*-4*c*, in this method a supply phase is located in the first part of the half-cycle (phase angle 0° to <40°). This supply phase in the method shown in FIGS. 5*a-c* has a stepped design with a first and a second part, with a higher shunt current flowing in the first part of the supply phase $P_V$ than in the subsequent, shorter second part of the supply phase. The first part of the supply phase is ended in a time-controlled manner, as described above. The second part ends in a voltage-controlled manner, if the magnitude of the voltage between the supply terminals of the lamp unit 7 exceeds a predetermined voltage. In the first part of the supply phase, for example, currents of approximately 150 mA can flow. This current is limited by the control device and is used for supplying energy to said control device. In the second part of the supply phase, for example, currents of approximately 20 mA flow. This current is predetermined as the maximum shunt current of the lamp unit 7. The first part of the supply phase is used for charging the energy store 8, which is assigned to the control device 1. In order to keep current losses low in the lamp unit 7 and the control device 1 and to ensure a defined voltage rise at the input of the lamp unit 7 after conclusion of the supply phase, the supply phase is ended in the second part with the formation of an intermediate level (in this case approximately 20 mA). Once the supply phase has ended, the lamp unit 7 consumes the energy required for its operation in an operating phase. If this is concluded, the modulation phase $P_M$ of this half-cycle is carried out, to be precise with the shunt switch 10 closed, with this shunt in turn being capable of being at the lower level of the supply phase, which is carried out prior to the operating energy consumption (i.e. at approximately 20 mA in the exemplary embodiment illustrated). It has been demonstrated that fewer harmonic currents occur with this method refinement.

In the same way as described in relation to the exemplary embodiment in FIGS. 5*a-c*, in the exemplary embodiment shown in FIGS. 4*a-c* the supply phase $P_V$ can be split into two parts.

FIG. 6 illustrates, by way of example, a data telegram generated by the control device 1, which data telegram extends over a plurality of half-cycles, with the time axis (x axis) in each case being interrupted in order to indicate only the periods of time for the transmission of the control information item (modulation phases $P_M$). The encoding in this case takes place in accordance with the Manchester code, with the bits being encoded by voltage transitions from low to high voltage, and vice versa. The bit clock can be obtained from the voltage transitions of the Manchester-encoded signal. A frequency of 3 kHz or 10 kHz can be used as the fundamental, for example. The fundamental can possibly be adapted if the data telegram is intended to extend over the same number of half-cycles even in the event of a change in the system frequency.

At the beginning of data transmission in each half-cycle, a half bit 13 electrical high is transmitted. At the beginning of a telegram, in the exemplary embodiment described first a start identification (4 half bits 14: electrical high) and then a telegram type identification 15 (3 logic bits) follows. Then, the actual data bits 16 which contain the control information item are transmitted, in this case 8 logic bits. Finally, a parity bit 17 (1 logic bit) follows. Since the length of the data telegram is already fixed by the telegram type identification, no stop identification is required. Once the data telegram, which extends over seven successive half-cycles in the exemplary embodiment illustrated, has concluded, the next telegram begins again with the start identification 14. The exemplary embodiment described provides that the data telegrams are transmitted cyclically and continuously. In this way, faults in the transmission can be corrected without delay. The transmission reliability can be increased by multiple evaluation.

LIST OF REFERENCE SYMBOLS

1 Control device
2 Control element
3 Supply line
4 Transformer
5 Control gear
6 Light-emitting means
7 Lamp unit
8 Capacitor/energy store
9 Shunt resistor
10 Switch
11 Decoder
12 Rectifier
13 Start half bit
14 Half bits (telegram start)
15 Logic bits (telegram type identification)
16 Logic data bits
17 Logic parity bit
F, F' Curve
L Phase N Neutral conductor
$P_M$ Modulation phase
$P_N$ Shunt phase
$P_V$ Supply phase

The invention claimed is:

1. A method for transmitting a control information item from a control device to at least one lamp unit with at least one light-emitting device, the lamp unit having a first and a second supply terminal, the first supply terminal being connected to the neutral conductor of an AC voltage power supply system, the second supply terminal being connected to an output of the control device via a supply line, a first input of the control device being connected to the phase conductor of the AC voltage power supply system, the method comprising:

modulating the control information item onto the supply line by the control device during a modulation phase, decoding the control information item, driving the light-emitting device in accordance with the decoded control information item, wherein a switchable shunt is connected between the first and the second supply terminal, at least during the modulation phase, and the shunt has a current-limiting effect and permits only a maximum shunt current.

2. The method as claimed in claim 1, wherein during the modulation phase, the voltage on the supply line is modulated with a substantially constant amplitude.

3. The method as claimed in claim 2, wherein modulating is performed with an amplitude whose value is in a range of from 2 volts to 10 volts.

4. The method as claimed in claim 1, wherein the maximum shunt current during the modulation phase is in a range of from 2 mA to 30 mA.

5. The method as claimed in claim 1, wherein the shunt is deactivated as long as the magnitude of the instantaneous value of the voltage between the supply terminals exceeds a predetermined value.

6. The method as claimed in claim 1, further comprising an operating phase, in which the lamp unit consumes energy which is used for generating light, the shunt being deactivated at least during the operating phase.

7. The method as claimed in claim 1, further comprising a supply phase, the supply phase having at least one first part, during which the shunt current is limited by the control device to a value below the maximum shunt current predetermined by the lamp unit.

8. The method as claimed in claim 7, wherein in the first part of the supply phase, the maximum shunt current is set by the lamp unit to a value in the range of between 200 mA and 400 mA, while the shunt current is limited by the control device to a value below 200 mA.

9. The method as claimed in claim 7, wherein the first part of the supply phase is restricted to a predetermined supply time.

10. The method as claimed in claim 9, wherein the value of the supply time is in a range of between 600 microseconds and 800 microseconds.

11. The method as claimed in claim 7, wherein the first part of the supply phase directly follows a voltage zero crossing of the AC voltage power supply system.

12. The method as claimed in claim 11, wherein a second part of the supply phase follows the first part of the supply phase, in the second part of the supply phase the lamp unit reducing the maximum shunt current at least to such an extent that no permanent damage to the shunt is possible even when the AC voltage power supply system is applied to the supply terminals, and, in the second part of the supply phase, the AC voltage power supply system being connected by the control device to the supply terminals.

13. The method as claimed in claim 12, wherein, in the second part of the supply phase, the maximum shunt current is set to a value of below 30 mA by the lamp unit.

14. The method as claimed in claim 7, wherein the first part of the supply phase is ended by a voltage zero crossing of the AC voltage power supply system.

15. The method as claimed in claim 14, wherein a second part of the supply phase precedes the first part of the supply phase, in the second part of the supply phase the lamp unit reducing the maximum shunt current at least to such an extent that no permanent damage to the shunt is possible even when the AC voltage power supply system is applied to the supply terminals, and, in the second part of the supply phase, the AC voltage power supply system being connected to the supply terminals by the control device.

16. The method as claimed in claim 7, wherein the control device has an energy store, which is charged during the modulation phase and/or the/a supply phase.

17. The method as claimed in claim 1, wherein a compact fluorescent lamp is used as the light-emitting device, and the modulation phase is ended at a phase angle of the AC voltage power supply system of approximately 50-60 degrees or is started at a phase angle of the AC voltage power supply system of approximately 100-130 degrees.

18. The method as claimed in claim 1, wherein the modulation is performed at a frequency of between 1 kHz and 20 kHz.

19. The method as claimed in claim 1, wherein the control information item contains control commands for controlling the brightness and/or the color of the light-emitting device.

20. The method as claimed in claim 1, wherein one or more LEDs are used as the light-emitting device.

21. The method as claimed in claim 1, wherein the control information item is split into a plurality of successive half-cycles of the AC voltage power supply system.

22. The method as claimed in claim 1, wherein the control information item is transmitted cyclically.

23. The method as claimed in claim 1, wherein the control information item is encoded by a Manchester code.

24. A lamp unit configured for use in with a control device having a first input connected to a phase conductor of an AC voltage power supply system, wherein the lamp unit comprises:

a first and second supply terminal, the first supply terminal configured to be connected to a neutral conductor of the AC voltage system, the second supply terminal configured to be connected to an output of the control device via a supply line and to receive a modulated control information item from the control device via the supply line, a light-emitting device, a transformer, which is configured to convert electrical energy which is provided at the supply terminals into a form which is suitable for the light-emitting device and feeds this to the light-emitting device, a decoder for decoding the modulation of the AC voltage at the supply terminals, the decoder decoding the control information item, with which the transformer can be controlled, the light emitting device configured to be driven in accordance with the control information item, and a switchable shunt connected between the supply terminals, which shunt is connected at least as long as the AC voltage at the supply terminals is modulated, and the shunt has a current-limiting effect and permits only a maximum shunt current.

25. The lamp unit as claimed in claim 24, wherein the value of the maximum shunt current is between 2 mA and 30 mA if the AC voltage at the supply terminals is modulated.

26. The lamp unit as claimed in claim 24, wherein the decoder deactivates the shunt as long as the magnitude of the instantaneous value of the voltage between the supply terminals exceeds a predetermined value.

27. The lamp unit as claimed in claim 26, wherein the decoder deactivates the shunt if the magnitude of the instantaneous value of the voltage between the supply terminals is over 100 V.

28. The lamp unit as claimed in claim 24, wherein the lamp unit is configured to provide a supply phase with a first part, which is restricted to a fixed supply time, in which the decoder sets the maximum shunt current to a value in the range of between 200 mA and 400 mA.

29. The lamp unit as claimed in claim 28, wherein the decoder suppresses the supply phase if the AC voltage at the supply terminals does not have any modulation during at least one half-cycle.

30. The lamp unit as claimed in claim 24, wherein the decoder deactivates the shunt until the lamp unit is next brought into operation if the AC voltage at the supply terminals does not have any modulation during at least one half-cycle.

31. The lamp unit as claimed in claim 24, wherein the lamp unit is configured to provide an off state, in which the decoder shuts down the transformer.

32. A lighting system comprising at least one lamp unit as claimed in claim 24 and a control device having a first input connected to a phase conductor of an AC voltage power system and an output, wherein the first supply terminal of the lamp unit is connected to the output of the control device, and an AC voltage power supply system is configured to connect between the second supply terminal of the lamp unit and the first input of the control device, the control device configured to provide the modulated control information item to the lamp unit.

33. The lighting system as claimed in claim 32, wherein a plurality of lamp units are connected in parallel.

34. The lighting system as claimed in claim 32, wherein the decoder of the lamp unit modulates the current in the shunt, the control device evaluating the modulated current, as a result of which the control device can receive information items from the lamp unit.

35. A control device configured and the shunt has a current-limiting effect and permits only a maximum shunt current, for transmitting a control information item from the control device to at least one lamp unit with at least one light-emitting device, the lamp unit having a first and a second supply terminal, the first supply terminal being connected to the neutral conductor of an AC voltage power supply system, the second supply terminal being connected to an output of the control device via a supply line, a first input of the control device being connected to the phase conductor of the AC voltage power supply system, a switchable shunt being connected between the first and second supply terminals at least during a modulation phase, the control device comprising:

an energy store for the short-term storage of energy required for the operation of the control device, a first input and an output, a modulator configured to generate a modulation voltage between the first input and the output, and an encoder, which encodes the control information item into a digital bit pattern, which controls the modulation voltage during a modulation phase wherein the modulation voltage is substantially constant, the control information configured to be modulated onto the supply line and decoded to drive the light-emitting device in accordance with the decoded control information.

36. The control device as claimed in claim 35, wherein the control device is configured to provide a supply phase with a first part, during which the current through the control device produces the energy for charging the energy store.

37. The control device as claimed in claim 36, wherein, during the supply phase, the voltage across the control device is constant or corresponds to the instantaneous value of the AC voltage power supply system.

38. The control device as claimed in claim 36, wherein the control device limits the current through the control device during the first part of the supply phase to a value which is less than or equal to 150 mA.

39. The control device as claimed in claim 35, wherein the control device has a second input, the first and second input configured to supply the control device with the energy required in the control device.

40. The control device as claimed in claim 35, wherein the control device generates a modulation voltage, which the control device adds to the voltage at the first input or subtracts from the voltage at the first input.

* * * * *